US010925450B2

(12) United States Patent
Schultink et al.

(10) Patent No.: US 10,925,450 B2
(45) Date of Patent: Feb. 23, 2021

(54) METHOD FOR INTEGRAL CONNECTION OF A RETAINING PLATE TO THE WALL OF A VACUUM CLEANER FILTER BAG AND ALSO VACUUM CLEANER FILTER BAG

(71) Applicant: Eurofilters N.V., Overpelt (BE)

(72) Inventors: Jan Schultink, Overpelt (BE); Ralf Sauer, Overpelt (BE)

(73) Assignee: EUROFILTERS HOLDING N.V., Overpelt (BE)

( * ) Notice: Subject to any disclaimer, the term of this patent is extended or adjusted under 35 U.S.C. 154(b) by 329 days.

(21) Appl. No.: 16/060,746

(22) PCT Filed: Dec. 12, 2016

(86) PCT No.: PCT/EP2016/080568
§ 371 (c)(1),
(2) Date: Jun. 8, 2018

(87) PCT Pub. No.: WO2017/098035
PCT Pub. Date: Jun. 15, 2017

(65) Prior Publication Data

US 2018/0368635 A1 Dec. 27, 2018

(30) Foreign Application Priority Data

Dec. 12, 2015 (EP) ..... 15199696

(51) Int. Cl.
*B01D 46/02* (2006.01)
*A47L 9/14* (2006.01)

(52) U.S. Cl.
CPC ..... *A47L 9/1436* (2013.01)

(58) Field of Classification Search
CPC ..... A47L 9/14; A47L 9/1436; B01D 46/02
(Continued)

(56) References Cited

U.S. PATENT DOCUMENTS

2009/0031683 A1* 2/2009 Schultink ..... A47L 9/14 55/382
2009/0308032 A1* 12/2009 Schultink ..... A47L 9/14 55/382

(Continued)

FOREIGN PATENT DOCUMENTS

DE 102006029059 * 12/2007 ..... A47L 9/1436
DE 20 2008 002 010 U1 7/2008

(Continued)

OTHER PUBLICATIONS

Tom Holiday, What is scrim?, Aug. 1985, Scrimco, inc., p. 2, <http://www.scrimco.com/whatisscrim.html> (Year: 1985).*

(Continued)

*Primary Examiner* — Minh Chau T Pham
(74) *Attorney, Agent, or Firm* — Brinks Gilson & Lione

(57) ABSTRACT

The present invention relates to methods for the production of an improved integral connection of a retaining plate to the wall of a vacuum cleaner filter bag. According to a first variant, the retaining plate is not applied directly on the wall of the vacuum cleaner filter bag but rather a textile material is disposed between retaining plate and the wall. The connection of the retaining plate and the wall of the vacuum cleaner filter bag is thereby effected via the textile material. According to a second variant, in regions between retaining plate and wall of the vacuum cleaner filter bag, a film made of a thermoplastic material is disposed between wall of the vacuum cleaner filter bag and retaining plate. The connection of the retaining plate and the wall of the vacuum cleaner filter bag is thereby effected via the film. According to a third variant, the retaining plate is connected directly to the wall of the vacuum cleaner filter bag. The wall is thereby formed, at least in the region in which the retaining plate is applied, as film made of special thermoplastic materials. The present invention relates likewise to vacuum cleaner filter bags in (Continued)

Figure 1:
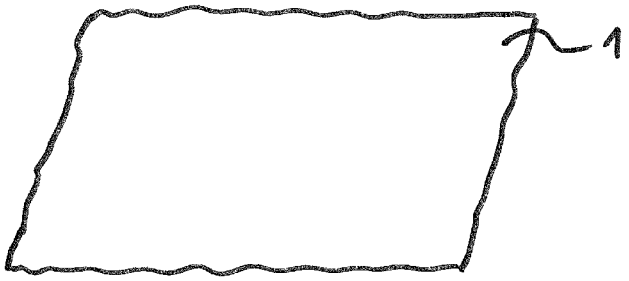
Figure 1:
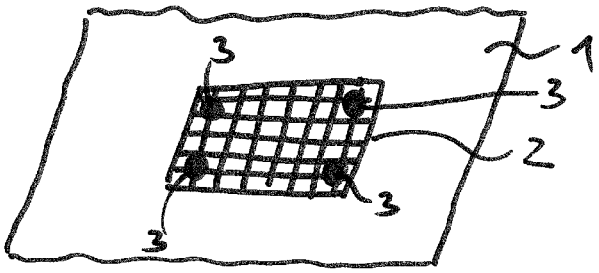
Figure 1:
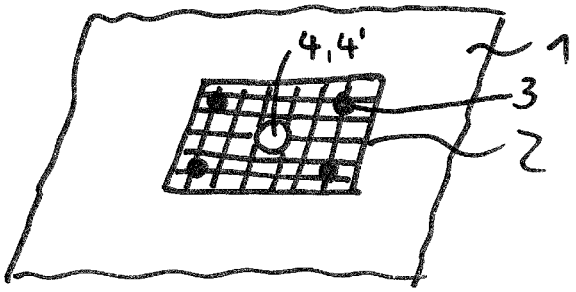
Figure 1:
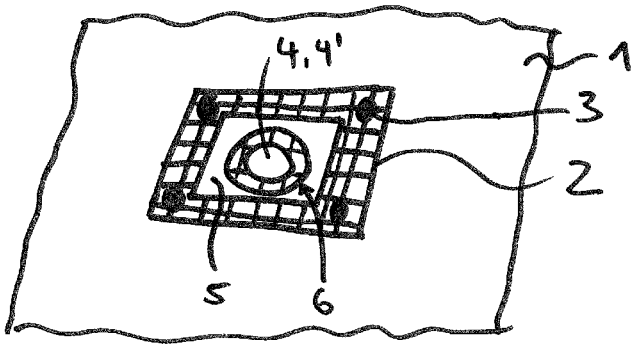

which the retaining plate is connected integrally to the wall of the vacuum cleaner filter bag according to the preceding principles.

21 Claims, 4 Drawing Sheets

(58) Field of Classification Search
USPC ..... 55/309, 367, 368, 372, 374, 382, 486, 55/DIG. 2, DIG. 5; 15/347, 352, 353; 96/222, 223, 226, 227
See application file for complete search history.

(56) References Cited

U.S. PATENT DOCUMENTS

2011/0047945 A1* 3/2011 Schultink ..... A47L 9/14 55/368
2012/0131890 A1* 5/2012 Schultink ..... A47L 9/14 55/368
2014/0352102 A1* 12/2014 Schultink ..... A47L 9/1445 15/347

FOREIGN PATENT DOCUMENTS

DE 202008004025 U1 * 8/2009 ..... A47L 9/1436
DE 20 2008 004 025 U1 9/2009
EP 2 025 278 A1 2/2009
EP 2 311 358 A1 4/2011

OTHER PUBLICATIONS

First Office Action in corresponding Chinese Application No. CN 201680081239.3, dated Mar. 17, 2020, including English summary and Chinese original.
International Search Report dated Feb. 15, 2017 for International Application No. PCT/EP2016/080568.
International Preliminary Report on Patentability dated Jun. 12, 2018 for International Application No. PCT/EP2016/080568.

* cited by examiner a)

b)

c)

d)

e)

f)

METHOD FOR INTEGRAL CONNECTION OF A RETAINING PLATE TO THE WALL OF A VACUUM CLEANER FILTER BAG AND ALSO VACUUM CLEANER FILTER BAG

This application claims the benefit under 35 U.S.C. § 371 of International Application No. PCT/EP2016/080568, filed Dec. 12, 2016, which claims the priority of European Patent Application No. 15199696.4, filed Dec. 12, 2015; which are incorporated by reference herein in their entirety.

The present invention relates to methods for the production of an improved integral connection of a retaining plate to the wall of a vacuum cleaner filter bag. According to a first variant, the retaining plate is not applied directly on the wall of the vacuum cleaner filter bag but rather a textile material is disposed between retaining plate and the wall. The connection of the retaining plate and the wall of the vacuum cleaner filter bag is thereby effected via the textile material. According to a second variant, in regions between retaining plate and wall of the vacuum cleaner filter bag, a film made of a thermoplastic material is disposed between wall of the vacuum cleaner filter bag and retaining plate. The connection of the retaining plate and the wall of the vacuum cleaner filter bag is thereby effected via the film. According to a third variant, the retaining plate is connected directly to the wall of the vacuum cleaner filter bag. The wall is thereby formed, at least in the region in which the retaining plate is applied, as film made of special thermoplastic materials. The present invention relates likewise to vacuum cleaner filter bags in which the retaining plate is connected integrally to the wall of the vacuum cleaner filter bag according to the preceding principles.

In the case of vacuum cleaner filter bags which consist of a thermoplastic film in a partial region or have such a one, it can be necessary to apply a retaining plate precisely in this region. Typically, the connection of a vacuum cleaner bag retaining plate to the nonwoven of a filter bag is effected by gluing by means of a thermally activatable adhesive (e.g. Hotmelt) or by ultrasonic welding. This is used preferably because of the short welding time and the high strength and process reliability of the weld connection. Directional indicators on the retaining plate and also structurings on the sonotrode or on the anvil further increase the performance of the ultrasonic welding.

The ultrasonic welding of a retaining plate to a film proves however to be surprisingly difficult. The achieved highest tensile strengths are unsatisfactory, directional indicators often lead in fact to poorer results than welding with planar, smooth retaining plates to the film and the structuring of sonotrode or anvil likewise barely improves the result.

Therefore, to date the problem has still not been resolved as to how to produce a reliable connection, in particular by welding of the retaining plate to the wall of the filter bag, in particular if this consists of film. The welding can be made difficult in addition if the retaining plate has a mechanism for automatic closing of a flap during removal from the vacuum cleaner. These mechanisms have various metallic springs which are anchored in the retaining plate. In the region of these often form-fitting anchorings, high material thicknesses are present which counteract the ultrasonic conduction. Also the spring itself often leads to undesired distribution of the ultrasound in the workpiece so that, at the actually desired welding position, sufficient energy is no longer available.

It is hence the object of the present invention to indicate reliable methods for connection of a retaining plate to the wall of a vacuum cleaner filter bag with which the previously mentioned disadvantages can be avoided. In particular, the connection between retaining plate and the wall of the filter bag is intended to be produced easily, the produced connection is thereby intended to withstand high tensile loads, the obtained results are intended likewise to be reproducible. In addition, it is the object of the present invention to indicate corresponding vacuum cleaner filter bags.

This object is achieved respectively with the methods for integral connection of a retaining plate to the wall of a vacuum cleaner filter bag by the features of patent claims 1, 15 and 16, with respect to vacuum cleaner filter bags, by the features of patent claims 17, 21 and 22. The respective dependent patent claims thereby represent advantageous developments.

Hence the invention relates, according to a first aspect, to a method for integral connection of a retaining plate to the wall of a vacuum cleaner filter bag. The wall of the vacuum cleaner filter bag thereby has a location provided for applying the retaining plate. This location can be situated, according to the configuration of the vacuum cleaner filter bag to be produced later from the wall of the vacuum cleaner filter bag, at various places.

According to a first variant of this aspect, it is provided that, at least in regions in the region of the application location of the retaining plate, at least in regions, an integral, frictional or form-fitting connection of the wall of the vacuum cleaner filter bag to at least one, in particular precisely one, layer of a textile material is produced, and the retaining plate is pressed on the side of the wall of the vacuum cleaner filter bag, provided with the textile material, at the application location. Subsequently, an integral connection between the wall of the vacuum cleaner filter bag, the textile material and the retaining plate is produced.

According to this first variant of the first aspect according to the invention, firstly at least one layer of a textile material, for example a single layer of a textile material, is applied at the application location of the retaining plate on the wall of the vacuum cleaner filter bag and is connected there at least in regions to the wall of the vacuum cleaner filter bag.

There is thereby understood by the application location, the region of the wall of the vacuum cleaner filter bag on which the retaining plate is disposed later, i.e. the region of the wall which is defined in projection on the wall of the outline of the retaining plate.

Application of the textile material can thereby be effected merely in regions of the application location, so that only a part of the area on which the retaining plate is disposed later, is provided with a textile material. This embodiment is particularly sensible when it is sufficient to have reinforcement, merely at points or in regions, of the connection of the retaining plate to the wall of the vacuum cleaner filter bag. For reinforcement, also one or more strips made of textile material can suffice. In particular, the region of the connection, e.g. the weld, which experiences the highest stress, can be reinforced.

Likewise, it is possible to equip the entire area which defines the application location of the retaining plate with a textile material.

It is also possible to choose the area of the textile material to be larger than the area of the application location so that, after connection of the retaining plate to the wall, textile material protrudes below the retaining plate.

The connection, at least in regions, of the textile material to the wall can take place for example by welding at points, gluing at points but also via mechanical durable or temporary fixings, such as for example clamp connections etc.

After the textile material has been fixed at the provided place on the wall of the vacuum cleaner filter bag corresponding to the preceding procedure, the retaining plate is pressed onto the textile material such that at least a part of the area of the retaining plate comes to lie on the textile material. Likewise, it is possible that the entire area of the retaining plate is adapted to the textile material, in the case where the area of the textile material chosen for this purpose is correspondingly large, i.e. is at least as large as the base area of the retaining plate.

Finally, the production of an integral connection between the wall of the vacuum cleaner filter bag and the retaining plate is effected through the textile material. This can be effected for example by welding, in particular ultrasonic welding or by means of gluing. In the latter case, for example just before pressing the retaining plate onto the textile material, an adhesive can be applied either on the textile material, the retaining plate or the textile material and the retaining plate.

A second variant of the first aspect according to the invention provides that, at least in regions on the retaining plate, at least in regions, an integral, frictional or form-fitting connection of the retaining plate to at least one, in particular precisely one, layer of a textile material is produced, and the retaining plate is pressed with the side, provided with the textile material, on the wall of the vacuum cleaner filter bag, at the application location. Here also, subsequently the production of an integral connection between wall and textile material is effected in the previously described manner.

In contrast to the previously discussed first variant, in the second variant presented here, the textile material is fixed at least in regions of the retaining plate, at least in regions, on the latter, the retaining plate is then pressed together with the textile material, fixed at least in regions, on the wall of the vacuum cleaner filter bag, at the application location, and connected through the textile material to the latter.

The textile material can thereby be applied, e.g. merely in regions of the retaining plate, e.g. such that the textile material does not fill the entire area of the retaining plate, or such that an edge of the retaining plate protrudes from the textile material but not such that the entire area of the retaining plate, which is connected later to the wall, is covered by textile material. Likewise, it is possible that the textile material covers the entire area of the retaining plate, also such that there is an excess of the textile material beyond the edge of the retaining plate. In the case where the retaining plate has an inlet opening for a vacuum cleaner connection piece, there can be introduced into the textile material—in the case where it is disposed on the retaining plate such that the inlet opening is partially or completely covered—a through-opening into the textile material before or after application on the retaining plate. Introduction of the through-opening is likewise possible after producing the connection of the retaining plate to the wall of the vacuum cleaner filter bag.

Connection of the textile material to the retaining plate can be effected analogously to the embodiments for connecting the textile material to the wall according to the first variant, i.e. likewise for example by welding at points, gluing at points but also via mechanical, durable or temporary fixings, such as for example clamp connections etc. In addition, the possibility is hereby given of moulding the textile material already during the production process of the retaining plate jointly on the latter. In particular if the retaining plate is produced by injection moulding methods, the textile material can be introduced for example already in the injection mould and hence be connected directly to the retaining plate during the injection moulding process.

Connection of the retaining plate provided with the textile material is effected furthermore identically to the first variant, i.e. here also, a corresponding gluing or welding of the retaining plate to the wall via the textile material can be undertaken.

According to a third variant of the first aspect of the method according to the invention, it is provided that, between the wall of the vacuum cleaner filter bag and the retaining plate at least in regions, in the region of the application location of the retaining plate, at least one, in particular precisely one, layer of a textile material is introduced, the retaining plate together with the textile material is pressed on the wall of the vacuum cleaner filter bag, at the application location. Here also, finally an integral connection between wall and retaining plate is effected via the textile material. According to this variant, the textile material is introduced without previous fixing between wall and retaining plate, for example is inserted at the provided location, a single bonding process is effected in which the retaining plate is connected through the textile material to the wall of the vacuum cleaner filter bag.

In this third variant also, corresponding to the preceding explanations, the textile material can be applied merely in regions of the application location so that only a part of the area on which the retaining plate is disposed later is provided with a textile material. Likewise, it is possible to equip the entire area, which defines the application location of the retaining plate, with a textile material. It is also possible to choose the area of the textile material to be larger than the area of the application location so that, after connecting the retaining plate to the wall, textile material protrudes below the retaining plate.

Surprisingly, it was able to be established that, when producing a connection between a retaining plate and a wall of a vacuum cleaner filter bag, a significant improvement in the welding result can be noted. In particular, it could thereby be established that the ultrahigh tensile strength for detachment of the connected retaining plate from the wall of the vacuum cleaner filter bag can be increased significantly. This can be observed in particular if the wall of the vacuum cleaner filter bag, at least in the region in which the application of the retaining plate is effected or is intended to be effected, is formed from a film.

A preferred embodiment provides that the wall of the vacuum cleaner filter bag, at least in the region of the application location of the retaining plate, comprises a thermoplastic material or consists hereof or is formed herefrom. Preferred thermoplastic materials which are possible for the wall of the vacuum cleaner filter bag are hereby polyolefins, in particular polyethylene, polypropylene or polystyrene, polyesters, in particular PET, PBT, PC or PLA, thermoplastic elastomers, in particular TPE-O, TPE-V, TPE-U, TPE-E, TPE-S or TPE-A, poly(meth)acrylates, polyamides, polybenzimidazoles, polyether sulphones, polyetheretherketones, polyetherimides, polyphenylene oxides, polyphenylene sulphides and polytetrafluoroethylene and also mixtures, blends or combinations hereof. The wall of the vacuum cleaner filter bag can thereby be configured, at least in the region of the application location of the retaining plate, for example as film or as nonwoven.

Likewise it is preferred if the textile material comprises thermoplastic fibres and/or thermoplastic filaments or consists hereof or is formed herefrom.

The thermoplastic fibres or filaments of the textile material can thereby be formed from identical or different materials which were mentioned previously for the wall of the vacuum cleaner filter bag.

Furthermore, it is advantageous if at least the abutment side of the retaining plate comprises a thermoplastic material, at least in regions, or consists of or is formed completely from a thermoplastic material or the entire retaining plate consists of or is formed from a thermoplastic material.

Also for the purposes of the retaining plate, in particular the thermoplastic materials mentioned further back for the wall of the vacuum cleaner filter bag, are possible. The materials of the retaining plate can thereby represent the same or different materials which are used for the wall of the vacuum cleaner filter bag or of the textile material.

According to an embodiment to be preferred in particular, the thermoplastic fibres and/or the thermoplastic filaments of the textile material are formed from a material which has a melting temperature which is less than or equal to, preferably less than, particularly preferably less by at least 10° C., in particular less by at least 20° C., than the melting temperature of the thermoplastic material of the wall of the vacuum cleaner filter bag and/or than the melting temperature of the thermoplastic material of the retaining plate, the melting temperature being determined respectively according to ISO 11357-3:2011-05, and/or has a melt flow index (melt mass flow rate, melt flow rate (MFR)) which is greater than or equal to, preferably greater than, particularly preferably greater by a factor 5 to 20, than the melt flow index of the thermoplastic material of the wall of the vacuum cleaner filter bag and/or than the melt flow index of the thermoplastic material of the retaining plate, the melt flow index being determined respectively according to ISO 1133-1:2011-12, at a nominal load of 2.16 kg and a temperature of 230° C. These parameters for determining the melt flow index must be adapted if necessary as a function of the thermoplastic materials used. It is essential that only MFI which were determined with the same parameters are compared. The temperature is fixed in the case of greatly different plastic materials (e.g. PP and TPE) such that both plastic materials are melted at this temperature. The nominal load is established such that the output rate for both melts is within a readily measurable range. These adaptations are familiar to the person skilled in the art.

The thermoplastic materials of the textile material hence melt earlier, i.e. at lower temperatures than the thermoplastic materials of the wall and/or of the retaining plate and/or are of a lower viscosity at the same temperature. Due to the early melting and/or the lower viscosity of the melt of these materials, in particular in the case of a weld connection, an improved wetting of the wall and of the retaining plate is effected so that a more significant improvement in the connection between retaining plate and wall of the vacuum cleaner filter bag can be observed.

There should be mentioned as particularly preferred thermoplastic material for the wall of the vacuum cleaner filter bag, polyolefins, in particular polypropylene or polyethylene, polyester or—in the case where the wall is formed at least at the application location as film laminate—thermoplastic polymers, in particular TPE or TPU, as layer of this laminate orientated towards the retaining plate.

There are used as materials for the retaining plate, in particular polyolefins, such as polypropylene or polyethylene or polyester, in particular PET.

The materials which are particularly suitable for the textile material are preferably thermoplastic elastomers, such as e.g. TPE or TPU. However, it is likewise possible that the textile material is formed from the same thermoplastic materials as the retaining plate or the wall, however in this case it is preferred, as described above, if the thermoplastic material has a lower melting point. In the case where e.g. both wall, retaining plate and textile material are formed from PP, it is advantageous to use a PP type for the textile material which has a lower melting point and/or a higher MFI, than the PP types which are used for the retaining plate and the wall.

According to a preferred embodiment, the textile material is selected from the group consisting of nonwovens, nets, woven materials, knitted materials, fabrics, knitted materials, plaited materials, stitchbonded materials and felts and also combinations hereof. Particularly preferred hereby are nonwovens and nets (nettings), in particular spun nonwovens and crimped nonwovens being preferred in the case of the nonwovens.

According to a further preferred embodiment, the textile material has a planar configuration and in particular a basis weight of 5 to 200 g/m$^2$, preferably 10 to 100 g/m$^2$, particularly preferably 15 to 50 g/m$^2$.

The advantages of the present invention are useful in particular when the wall of the vacuum cleaner filter bag, at least in the region in which the retaining plate is intended to be fixed, consists of, as film, a thermoplastic material, a film laminate, in which at least the side on which the retaining plate is applied, made of a thermoplastic material or is configured from a nonwoven made of a thermoplastic material.

It is hereby particularly advantageous if the thermoplastic material of the film or of the side of the film laminate on which the retaining plate is applied is formed from a material which has a melt temperature which is less than or equal to, preferably less than, particularly preferably less by at least 10° C., in particular less by at least 20° C., than the melting temperature of the thermoplastic material of the retaining plate (5), the melting temperature being determined respectively according to ISO 11357-3:2011-05, and/or has a melt flow index (melt mass flow rate, melt flow rate (MFR)), which is greater than or equal to, preferably greater than, particularly preferably greater by a factor 5 to 20, than the melt flow index of the thermoplastic material of the retaining plate (5), the melt flow index being determined respectively according to ISO 1133-1:2011-12, at a nominal load of 2.16 kg and a temperature of 230° C.

As a result of the smooth surface of the film, it is difficult to weld a retaining plate reliably to the film. It is thereby suspected that, in particular in the welding process, no complete wetting of the film or of the film laminate can be effected. Surprisingly, the wetting, in particular of the film or of the film laminate, can be improved if a textile material is disposed between retaining plate and film or film laminate. It is hereby particularly preferred if the textile material thereby consists itself of a thermoplastic material, in particular of a thermoplastic elastomer, and for example likewise melts during the welding process. As a result, a significantly better wetting of the film can be achieved so that the resulting ultrahigh tensile strength, which can act on the retaining plate before partial or complete detachment of the retaining plate, can be significantly improved.

It is preferred in particular if the integral, frictional or form-fitting connection, at least in regions, of the wall of the vacuum cleaner filter bag to the textile material, the integral, frictional or form-fitting connection, at least in regions, of the retaining plate to the textile material, and/or the concluding production of the integral connection between the wall of the vacuum cleaner filter bag, the textile material and the retaining plate is effected by means of a welding process, in particular an ultrasonic welding process or by means of adhesive connection, in particular by means of a liquid adhesive, a 2K adhesive or a thermally liquefiable adhesive.

According to the present invention, it is possible to introduce respectively a bag inlet opening into the wall of the vacuum cleaner filter bag or a through-opening into the textile material and to make the respective openings congruent and in alignment in the various variants of the method indicated initially. Also an inlet opening, contained in the retaining plate, into which e.g. a vacuum cleaner connection piece can be introduced, is disposed in this case in alignment with the bag inlet opening and the through-opening.

In particular in the case of the variant of the method according to the invention which was mentioned first at the beginning, it is thereby preferred to produce firstly a connection, at least in regions, of the textile material to the wall of the vacuum cleaner filter bag at the application location of the retaining plate and, in a subsequent step, for example by means of a punching process, to introduce at the same time, a congruent bag inlet opening into the wall of the vacuum cleaner filter bag and a through-opening into the textile material. Subsequently, the retaining plate with its inlet opening can then be applied in alignment onto the through-opening of the textile material.

The geometric shape of the textile material can depend upon the weld seam geometry to be achieved. Typically the weld seam is round and has a width of a few mm to cm. It is also adequate to position a corresponding ring made of textile material between film and retaining plate and to connect it, with the known ultrasonic welding method, to the film and retaining plate in one step.

Basically, it is also possible first of all to fix the textile material lightly on the retaining plate or on the film and then to process it in a second step (ultrasonic welding).

The textile material can be configured for example as material strip which can be also wider than the desired weld seam in order to facilitate positioning.

The bag inlet opening of the wall of the vacuum cleaner filter bag and/or the through-opening of the textile material can thereby be dimensioned smaller or of equal size in diameter to the inlet opening of the retaining plate.

This embodiment provides that either the bag inlet opening of the wall of the vacuum cleaner filter bag or the through-opening of the textile material or the bag inlet opening of the wall of the vacuum cleaner filter bag and the through-opening of the textile material are dimensioned smaller in diameter than the inlet opening of the retaining plate. As a result of this thereby produced excess in the direction of the recess (filling hole), a seal is thereby configured which can seal the connection piece of the vacuum cleaner which is to be introduced into the interior of the resulting vacuum cleaner filter bag via the inlet opening of the retaining plate. In particular in the case of a smaller dimensioning of the through-opening of the textile material (and also possibly likewise of the bag inlet opening of the wall of the vacuum cleaner filter bag), a good sealing effect can hereby be observed. For example in the region of this resulting excess, the textile material can thereby in addition be connected, for example welded, to the wall of the vacuum cleaner filter bag. However, it is likewise possible to leave the textile material unconnected to the wall of the vacuum cleaner filter bag in this region.

It is likewise also possible to process an additional seal, for example a planar sealing element jointly during production according to the invention of the integral connection.

For this purpose, it is preferred if, at the application location of the retaining plate on the inside of the wall of the vacuum cleaner filter bag, at least one planar sealing element is introduced between the wall of the vacuum cleaner filter bag and the textile material and/or between the textile material and the retaining plate, which planar sealing element is preferably formed from TPE or TPU and has a through-opening which is disposed in alignment with the through-opening of the retaining plate, however has a smaller diameter than the diameter of the through-opening of the retaining plate.

Furthermore, it is preferred if the abutment side of the retaining plate is structured, at least in regions, and/or has energy directors for ultrasound. An energy director can be configured for example as a raised groove on the application side of the retaining plate.

Alternatively or additionally hereto, it is likewise possible that, in the case where the wall of the vacuum cleaner filter bag, at least in the region of the application location of the retaining plate, is configured as film or as film laminate, the film or the film laminate is structured at least at the application location, in particular is high-low structured, such as e.g. reeded.

Additionally or alternatively, the film used can also be a laminate made of two different thermoplastic materials. The layer of the laminate which is more easily activatable by ultrasound thereby points towards the retaining plate. If this layer is for example a TPE and the retaining plate is equipped with the TPE welding aid described in EP2311358 A1, a particularly good connection is achieved. Also in this case, the additional introduction of a textile material is further advantageous.

A further particularly preferred embodiment provides that, on the wall at least in the application location of the retaining plate on the wall and/or on the side of the textile material orientated towards the wall and/or on the side of the textile material orientated towards the retaining plate, a thermoplastic elastomer, such as e.g. in particular TPE-O, TPE-V, TPE-U, TPE-E, TPE-S or TPE-A, is applied at least in regions, e.g. via a printing process, in particular by means of functional screen printing.

The thermoplastic elastomer can be applied, e.g. in the form of knobs or concentric circles, on the respective surface.

According to a second aspect, the present invention relates to a further method for integral connection of a retaining plate to the wall of a vacuum cleaner filter bag at an application location provided for this purpose. In contrast to the first aspect, no textile material is inserted between retaining plate and wall for reinforcement of the connection but rather a film made of a thermoplastic material which is inserted merely in a region of the application location. Corresponding to the first aspect, also the second aspect of the method according to the invention is configured in three variants.

According to a first variant, in regions in the region of the application location of the retaining plate, at least in regions, an integral, frictional or form-fitting connection of the wall of the vacuum cleaner filter bag to at least one, in particular precisely one, layer of a film made of a thermoplastic material is produced, the retaining plate is pressed on the side, provided with the film, of the wall of the vacuum cleaner filter bag, at the application location, and subsequently an integral connection between the wall of the vacuum cleaner filter bag, the film and the retaining plate is produced.

According to a second variant, in regions on the retaining plate at least in regions, an integral, frictional or form-fitting connection of the retaining plate to at least one, in particular precisely one, layer of a film made of a thermoplastic material is produced, and the retaining plate is pressed with the side, provided with the film, on the wall of the vacuum cleaner filter bag, at the application location, and subsequently an integral connection between the wall of the vacuum cleaner filter bag, the film and the retaining plate is produced.

According to a third variant, between the wall of the vacuum cleaner filter bag and the retaining plate, in regions, in the region of the application location of the retaining plate, at least one, in particular precisely one, layer of a film made of a thermoplastic material is introduced, the retaining plate together with the film is pressed on the wall of the vacuum cleaner filter bag, at the application location, and subsequently an integral connection between the wall of the vacuum cleaner filter bag, the film and the retaining plate is produced.

It should thereby be ensured that, in the production of the concluding connection between wall, film and retaining plate, the connection is produced at least in the region in which the film is present.

Surprisingly, it could be established, also in this aspect of the invention, that when producing a connection between a retaining plate and a wall of a vacuum cleaner filter bag, a significant improvement in the welding result could be noted. In particular, it could thereby be established that the ultrahigh tensile strength for detachment of the connected retaining plate from the wall of the vacuum cleaner filter bag can be increased significantly. This can be observed in particular when the wall of the vacuum cleaner filter bag, at least in the region at which application of the retaining plate is effected or is intended to be effected, is formed from a film.

Preferably, the film is formed from a thermoplastic material which has a melting temperature which is less than or equal to, preferably less than, particularly preferably less by at least 10° C., in particular less by at least 20° C., than the melting temperature of the thermoplastic material of the wall of the vacuum cleaner filter bag and/or than the melting temperature of the thermoplastic material of the retaining plate (5), the melting temperature being determined respectively according to ISO 11357-3:2011-05, and/or has a melt flow index (melt mass flow rate, melt flow rate (MFR)), which is greater than or equal to, preferably greater than, particularly preferably greater by a factor 10 to 20, than the melt flow index of the thermoplastic material of the wall (1) of the vacuum cleaner filter bag and/or than the melt flow index of the thermoplastic material of the retaining plate (5), the melt flow index being determined respectively according to ISO 1133-1:2011-12, at a nominal load of 2.16 kg and a temperature of 230° C.

The materials which can be used in particular for the film correspond, according to a preferred embodiment, to the materials which were mentioned as preferred materials for the above-mentioned textile materials.

The film which is introduced between retaining plate and wall is thereby preferably configured as material strip.

For further preference, the film is thereby disposed not in the region of the inlet opening of the retaining plate or of the bag inlet opening of the wall of the vacuum cleaner filter bag but preferably in the edge region of the application location of the retaining plate.

The region in which the film is disposed thereby constitutes preferably 5 to 70%, further preferably 10 to 50%, particularly preferably 15 to 25%, of the area of the application location of the retaining plate.

The film introduced between wall and retaining plate can thereby be configured continuously or slotted and/or perforated.

A further particularly preferred embodiment provides that, on the wall at least in the application location of the retaining plate on the wall and/or on the side of the film orientated towards the wall and/or on the side of the film orientated towards the retaining plate, at least in regions, a thermoplastic elastomer, such as e.g. in particular TPE-O, TPE-V, TPE-U, TPE-E, TPE-S or TPE-A, is applied, e.g. via a printing process, in particular by means of functional screen printing. The thermoplastic elastomer can be applied, e.g. in the form of knobs or concentric circles, on the respective surface.

Furthermore, in particular with respect to the design of the wall of the filter bag and the design of the retaining plate, this second aspect of the invention is designed identically to the first aspect. In order to avoid repetition, reference is made to the preceding embodiments concerning the first aspect of the invention.

The connection possibilities with which the film can be connected to the wall or to the retaining plate at least in regions correspond to those which were explained already in the first aspect of the present invention. In particular there are hereby possible welding or gluing at points or over the entire area.

Also the concluding production of the connection between wall, film and retaining plate is thereby effected analogously to the production of the connection between wall, textile material and retaining plate according to the first aspect of the invention.

A third aspect of the present invention relates to a further method for integral connection of a retaining plate to the wall of a vacuum cleaner filter bag at an application location provided for this purpose. In contrast to the first and second aspect, no additional material is hereby introduced between wall and retaining plate. The retaining plate is connected directly to the wall of the vacuum cleaner filter bag.

According to the invention, it is provided in this aspect of the invention that the wall of the vacuum cleaner filter bag, at least in the region of the application location, consists of or is formed from, as film, a thermoplastic material or, as film laminate, in which at least the side on which the retaining plate is applied, a thermoplastic material, the thermoplastic material of the film or of the film laminate having a melting temperature which is less than or equal to, preferably less than, particularly preferably less by at least 10° C., in particular less by at least 20° C., than the melting temperature of the thermoplastic material of the retaining plate, the melting temperature being determined respectively according to ISO 11357-3:2011-05, and/or having a melt flow index (melt mass flow rate, melt flow rate (MFR)) which is greater than or equal to, preferably greater than, particularly preferably greater by a factor of 10 to 20, than the melt flow index of the thermoplastic material of the retaining plate, the melt flow index being determined respectively according to ISO 1133-1:2011-12, at a nominal load of 2.16 kg and a temperature of 230° C.

Surprisingly, also with this aspect of the invention, it could be established that, when producing a connection between a retaining plate and a wall of a vacuum cleaner filter bag, a significant improvement in the welding result could be noted. In particular, it could thereby be established that the ultrahigh tensile strength for detachment of the connected retaining plate from the wall of the vacuum cleaner filter bag can be increased significantly. This can then be observed in particular if the wall of the vacuum cleaner filter bag is formed, at least in the region at which the application of the retaining plate is effected or intended to be effected, from a film.

The thermoplastic materials of the film or of the side of the film orientated toward the retaining plate melt therefore earlier, i.e. at lower temperatures than the thermoplastic materials of the retaining plate and/or are of lower viscosity at the same temperature. As a result of the early melting and/or the lower viscosity of the melt of these materials, in the case of a weld connection, in particular an improved wetting of the wall—in this case of the film—and of the retaining plate is effected so that a more significant improvement in the connection between the retaining plate and wall of the vacuum cleaner filter bag can be observed.

As particularly preferred thermoplastic material for the film of the wall of the vacuum cleaner filter bag, there should be mentioned polyolefins, in particular polypropylene or polyethylene, polyester or—in the case where the wall is configured at least at the application location as film laminate—thermoplastic polymers, in particular TPE or TPU, as layer of this laminate orientated towards the retaining plate.

As materials for the retaining plate, in particular polyolefins, such as polypropylene or polyethylene or polyester, in particular PET, are used.

The materials which are suitable in particular for the side of the film laminate orientated towards the retaining plate are preferably thermoplastic elastomers, such as e.g. TPE or TPU.

However it is likewise possible that the film or the film laminate is formed from the same thermoplastic materials as the retaining plate or the wall, however in this case, as described above, it is preferred if the thermoplastic material has a lower melting point. In the case where e.g. both retaining plate and film or film laminate are formed from PP, it is advantageous, for the film or the film laminate, to use a PP type which has a lower melting point and/or a higher MFI than the PP types which are used for retaining plate and wall.

A further particularly preferred embodiment provides that, on the film or the film laminate, at least in the application location of the retaining plate, a thermoplastic elastomer, such as e.g. in particular TPE-O, TPE-V, TPE-U, TPE-E, TPE-S or TPE-A is applied on the wall at least in regions, e.g. via a printing process, in particular by means of functional screen printing. The thermoplastic elastomer can be applied, e.g. in the form of knobs or concentric circles, on the respective surface.

The retaining plate can thereby also have a closing flap which protrudes through the bag inlet opening into the interior of the vacuum cleaner filter bag and by means of which the bag inlet opening can be closed from inside. This flap can have e.g. a spring, by means of which self-closing of the bag inlet opening with the flap is possible.

In addition, the present invention relates to a vacuum cleaner filter bag, comprising a wall with an application location for a retaining plate, and also a retaining plate which is connected integrally to the wall at the application location and is connected to the wall, at least in regions, via at least one, in particular precisely one, layer of a textile material.

According to a preferred embodiment, it is provided that the wall of the vacuum cleaner filter bag, at least at the application location of the retaining plate, is formed from a film made of a thermoplastic material, from a film laminate, in which at least the side on which the retaining plate is applied, made of a thermoplastic material or from a non-woven made of a thermoplastic material.

It is thereby further preferred that the wall of the vacuum cleaner filter bag, in the region of the application location, has a bag inlet opening, that the textile material has a through-opening, and the retaining plate an inlet opening, bag inlet opening, through-opening and inlet opening being brought into alignment one above the other, in particular that the bag inlet opening and/or the through-opening are dimensioned smaller than or equal in size in diameter to the inlet opening.

A further preferred embodiment provides that, at the application location of the retaining plate on the inside of the wall of the vacuum cleaner filter bag, at least one planar sealing element is introduced between the wall of the vacuum cleaner filter bag and the textile material and/or between the textile material and the retaining plate, which is formed preferably from TPE or TPU and has a through-opening which is disposed in alignment with the through-opening of the retaining plate, however has a smaller diameter than the diameter of the through-opening of the retaining plate.

Furthermore, the invention relates to a vacuum cleaner filter bag, comprising a wall with an application location for a retaining plate and also a retaining plate which is connected integrally to the wall at the application location and is connected to the wall, in regions, via at least one, in particular precisely one, layer of a film made of a thermoplastic material.

The vacuum cleaner filter bag according to this variant is thereby essentially identical to the previously mentioned embodiment apart from the fact that the retaining plate is connected to the wall of the filter bag via a film, which is provided only in regions at the application location.

The preferred through-opening is introduced into the film in this case.

Furthermore, the invention relates to a vacuum cleaner filter bag, comprising a wall with an application location for a retaining plate, and also a retaining plate which is connected integrally to the wall at the application location, the wall of the vacuum cleaner filter bag, at least in the region of the application location, consisting of or being formed from, as film, a thermoplastic material or, as film laminate, in which at least the side on which the retaining plate is applied, a thermoplastic material, the thermoplastic material of the film or of the film laminate having a melt temperature which is less than or equal to, preferably less than, particularly preferably less by at least 10° C., in particular less by at least 20°, than the melting temperature of the thermoplastic material of the retaining plate (5), the melting temperature being determined respectively according to ISO 11357-3:2011-05, and/or having a melt flow index (melt mass flow rate, melt flow rate (MFR)) which is greater than or equal to, preferably greater than, particularly preferably greater by a factor 10 to 20, than the melt flow index of the thermoplastic material of the retaining plate (5), the melt flow index being determined respectively according to ISO 1133-1:2011-12, at a nominal load of 2.16 kg and a temperature of 230° C.

According to all the embodiments, the vacuum cleaner filter bags can be assembled from the initially described walls produced according to the invention by manufacturing methods known from the state of the art, e.g. as flat bag or as block base bag.

The present invention is explained in more detail with reference to the subsequent Figures without the present invention being restricted however to the specially illustrated embodiments.

There are hereby shown

Figure 2:
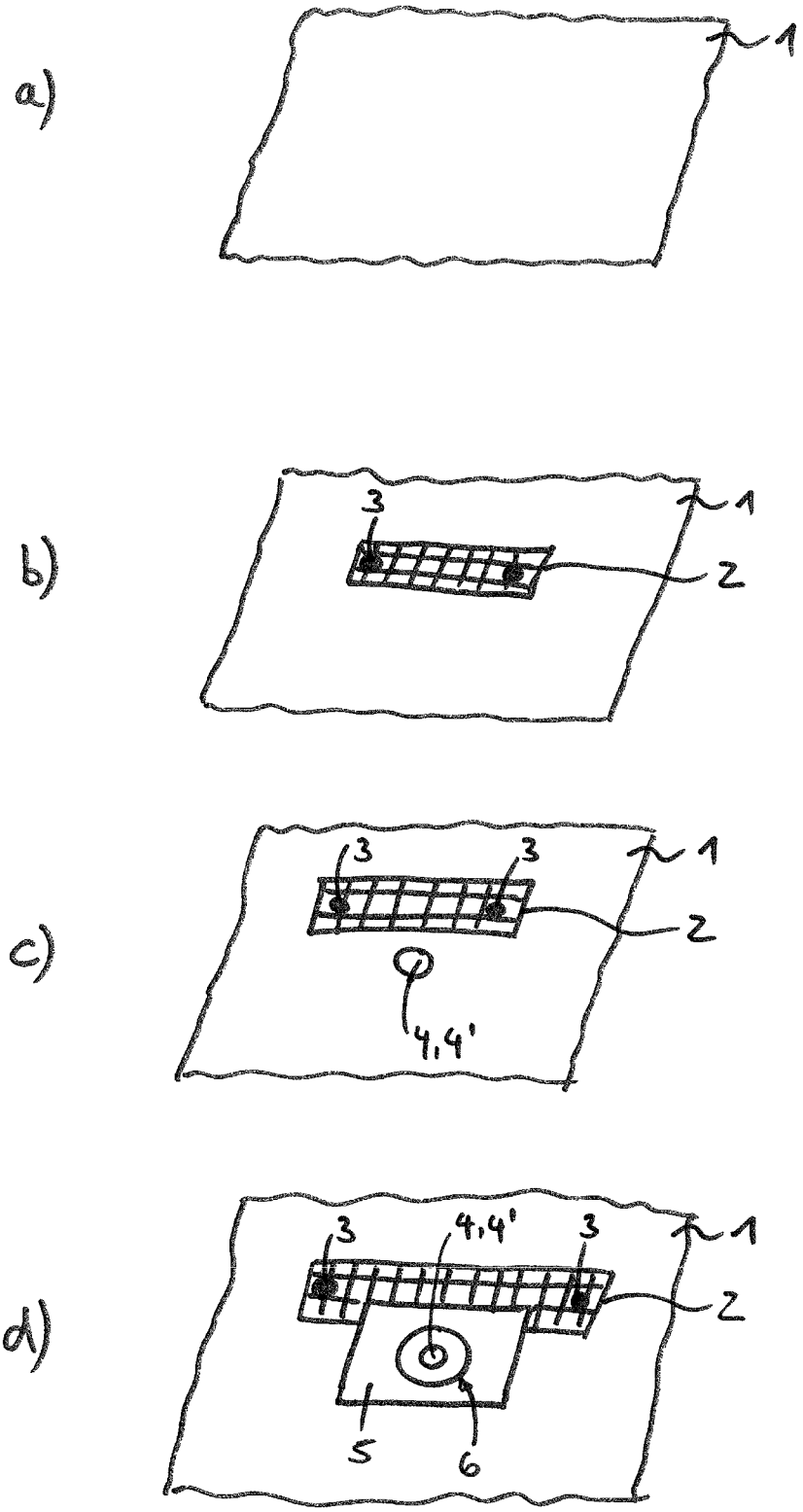
Figure 3:
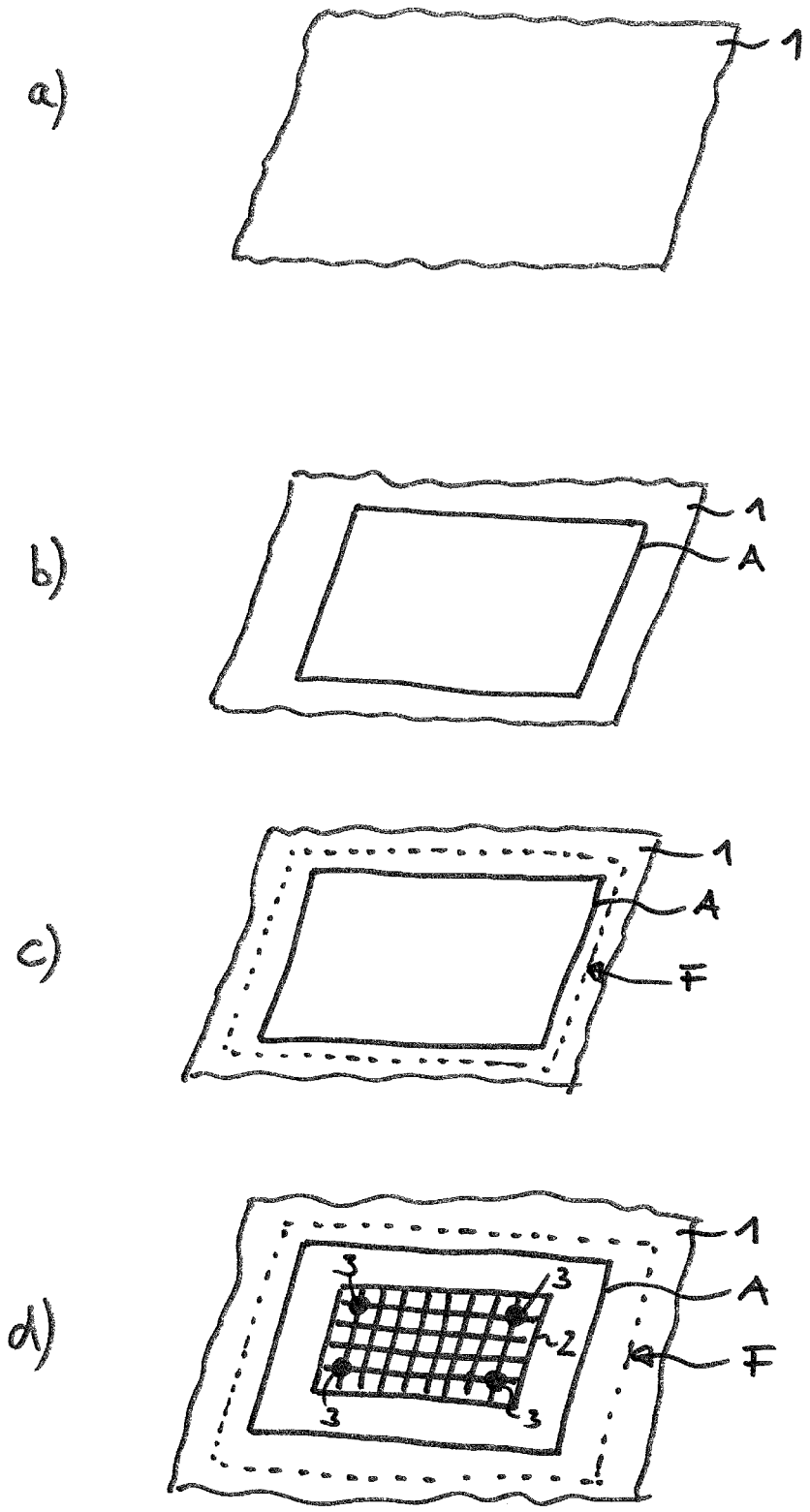
Figure 3:
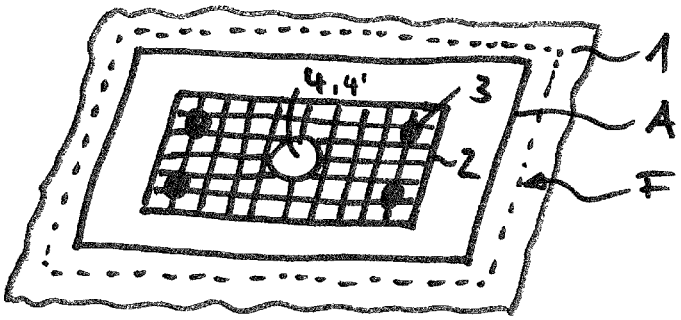
Figure 3:
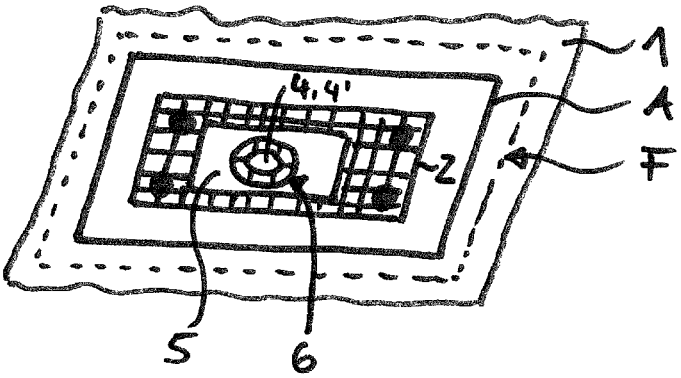

FIG. 1 a first variant for the production of a vacuum cleaner filter bag according to the invention, FIG. 2 a second variant of a vacuum cleaner filter bag according to the invention and also FIG. 3 a third variant for the production of a vacuum cleaner filter bag according to the invention.

FIG. 1 shows a first method according to the invention for the production of a wall according to the invention for a vacuum cleaner filter bag, which wall has an inlet opening. In the first step, which is illustrated in FIG. 1*a*), a wall 1 of a vacuum cleaner filter bag is prepared. The wall can thereby be for example a nonwoven material or else a film. Likewise laminates made of nonwovens or films are conceivable. These materials can be prepared for example as rolled goods and be wound endlessly. In FIG. 1 *a*) (as also in all the subsequent Figures), only a small section of the material of the wall 1 of the vacuum cleaner filter bag is illustrated.

FIG. 1*b*) shows the state after a textile material 2 was applied by means of four separate individual weld points 3 on one side of the wall 1 of the vacuum cleaner filter bag. The remaining area of the textile material 2 is thereby loose and not connected to the wall of the filter bag. Alternatively to the individual weld points 3, also gluing, at points, of the textile material 2 to the wall 1 of the vacuum cleaner filter bag can be effected. Likewise, it is also possible to undertake full-area connection, by means of welding or gluing of the textile material 2 to the wall 1 of the vacuum cleaner filter bag.

In the structure produced in FIG. 1*b*), subsequently (see FIG. 1*c*)), a common opening (bag inlet opening 4 in the textile material 2 and also through-opening 4' in the textile material 2) is introduced. Introduction of this opening can be effected for example by mutual punching, cutting or similar processes.

FIG. 1*d*) shows the state after which a retaining plate 5 with an associated inlet opening 6 was applied in alignment on the common opening (4, 4') of the composite made of wall 1 of the filter material and textile material 2. It is thereby detectable that the through-opening 6 of the retaining plate 5 has a larger diameter than the common opening (4, 4') of the wall of the filter bag and of the textile material. This excess which is visible inside the inlet opening of the retaining plate, thereby acts as seal for a connection piece of a vacuum cleaner which is to be introduced through the inlet opening 6 of the retaining plate 5.

The common connection between retaining plate 5 to the wall 1 of the vacuum cleaner filter bag via the textile material 2 is effected for example by an ultrasonic welding process in which ultrasound is introduced into the retaining plate by means of sonotrode and anvil. The weld seam can thereby be configured for example annularly about the inlet opening 6 of the retaining plate 5, however it is likewise possible to weld the retaining plate 5 only at points over the textile material 2 to the wall 1 of the vacuum cleaner filter bag. It is likewise possible to weld the retaining plate 5 over the entire area of the textile material 2 to the wall 1 of the vacuum cleaner filter bag.

Both the wall 1, the textile material 2 and also the retaining plate 5 are formed, in this example, from thermoplastic materials.

FIG. 2 shows a further embodiment for the production of a vacuum cleaner filter bag according to the invention.

The illustrated steps are thereby essentially identical to the step sequence which was presented in FIG. 1.

The only and substantial difference from the embodiment according to FIG. 1 is thereby that the textile material is dimensioned smaller. In the case of the example of FIG. 2, the textile material is thereby fixed to the wall 1 of the vacuum cleaner filter bag merely via two points 3 (for example via welding or gluing).

As a result of the smaller dimensioning, the textile material 2 does not overlap the bag inlet opening 4 which, in FIG. 2*c*), is now introduced merely into the wall of the vacuum cleaner filter bag.

By covering the retaining plate 5, the inlet opening of the retaining plate 6 being likewise made congruent and in alignment with the bag inlet opening 4, the retaining plate 5 abuts, only more in regions, on the textile material 2. In the concluding production of a connection of the retaining plate by means of the textile material 2 to the wall 1 of the vacuum cleaner filter bag (for example via a welding process), merely its region is hence particularly reinforced by the textile material 2 being present. This is adequate for example with already known tensile load on the vacuum cleaner filter bag.

FIG. 3 shows a further embodiment of a method according to the invention for the production of a vacuum cleaner filter bag according to the invention. FIG. 3*a*) is thereby identical to FIG. 1*a*) or FIG. 2*a*). In the case of the example of FIG. 3, the material of the wall of the vacuum cleaner filter bag is thereby configured as nonwoven.

In a first step, which is illustrated in FIG. 3*b*), now a recess A is introduced into the wall 1 of the vacuum cleaner filter bag. This can be effected for example by stamping out or cutting out.

As is illustrated in FIG. 3*c*), now on the rear-side of the wall 1 of the vacuum cleaner filter bag illustrated in perspective, a thermoplastic film F fixes the recess A overlapping at the wall 1 of the vacuum cleaner filter bag, for example by welding or gluing.

Subsequently, as illustrated in FIGS. 3*d*), a textile material 2 is fixed on the film F, for example by means of four weld points 3 viewed from the front-side in perspective.

The concluding steps e) and f) are thereby essentially identical to the embodiments which were presented already with respect to FIG. 1*c*) or 1*d*).

Common introduction of an opening through all the material layers, i.e. viewed from above, textile material 2, the wall of the vacuum cleaner filter bag 1 and also the film F situated behind, is also hereby effected.

After applying the retaining plate 5 with the inlet opening 6, fixing of the retaining plate by the textile material 2 to the film F which in this region forms the wall 1 of the vacuum cleaner filter bag is effected.

The invention claimed is:

1. A method for integral connection of a retaining plate to a wall of a vacuum cleaner filter bag at an application location, the method comprising:

a) at least in regions in a region of the application location of the retaining plate, at least in regions, producing an integral, frictional or form-fitting connection of the wall of the vacuum cleaner filter bag to at least one layer of a textile material, and pressing the retaining plate onto a side of the wall, provided with the textile material, of the vacuum cleaner filter bag, at the application location, or b) at least in regions on the retaining plate, at least in regions, producing an integral, frictional or form-fitting connection of the retaining plate to at least one layer of a textile material, and pressing the retaining plate with a side, provided with the textile material, onto the wall of the vacuum cleaner filter bag, at the application location, or c) between the wall of the vacuum cleaner filter bag and the retaining plate at least in regions, in the region of the application location of the retaining plate, introducing at least one layer of a textile material, and pressing the retaining plate together with the textile material onto the wall of the vacuum cleaner filter bag, at the application location, and subsequently producing an integral connection between the wall of the vacuum cleaner filter bag, the textile material and the retaining plate.

2. The method according to claim 1, wherein the wall of the vacuum cleaner filter bag, at least in the region of the application location of the retaining plate, comprises a thermoplastic material or consists thereof or is formed therefrom, the textile material comprises thermoplastic fibres or thermoplastic filaments or consists hereof or is formed herefrom, or at least an abutment side of the retaining plate comprises a thermoplastic material, at least in regions, or consists of or is formed completely from a thermoplastic material or the entire retaining plate consists of or is formed from a thermoplastic material.

3. The method according to claim 2, wherein the thermoplastic fibres or the thermoplastic filaments of the textile material are formed from a material which has a melting temperature which is less than or equal to the melting temperature of the thermoplastic material of the wall of the vacuum cleaner filter bag or than the melting temperature of the thermoplastic material of the retaining plate, the melting temperature being determined respectively according to ISO 11357-3:2011-05, or has a melt flow index (melt mass flow rate, melt flow rate (MFR)) which is greater than or equal to the melt flow index of the thermoplastic material of the wall of the vacuum cleaner filter bag or the melt flow index of the thermoplastic material of the retaining plate, the melt flow index being determined respectively according to ISO 1133-1:2011-12, at a nominal load of 2.16 kg and a temperature of 230° C.

4. The method according to claim 2, wherein the thermoplastic material of the wall of the vacuum cleaner filter bag, the material from which the thermoplastic fibres or the thermoplastic filaments of the textile material are formed or the thermoplastic material of the retaining plate is selected, respectively independently of each other, from the group consisting of polyolefins, poly(meth)acrylates, polyamides, polyesters, thermoplastic elastomers (TPE), polybenzimidazoles, polyether sulphones, polyetheretherketones, polyetherimides, polyphenylene oxides, polyphenylene sulphides and polytetrafluoroethylene and also mixtures, blends or combinations hereof.

5. The method according to claim 1, wherein the textile material is selected from the group consisting of nonwovens, nets, woven materials, knitted materials, fabrics, braided materials, plaited materials, stitchbonded materials and felts and also combinations hereof.

6. The method according to claim 5, wherein the nonwoven is selected from the group consisting of spun nonwovens and crimped nonwovens.

7. The method according to claim 1, wherein the textile material has a planar configuration and in particular a basis weight of 5 to 200 g/m2.

8. The method according to claim 1, wherein the wall of the vacuum cleaner filter bag, at least at the application location of the retaining plate, consists of a film made of a thermoplastic material, a film laminate, in which at least the side on which the retaining plate is applied, made of a thermoplastic material, or is formed from a nonwoven made of a thermoplastic material.

9. The method according to claim 8, wherein, the material of the film or of the side of the film laminate on which the retaining plate is applied is formed from a material which has a melt temperature which is less than or equal to the melting temperature of the thermoplastic material of the retaining plate, the melting temperature being determined respectively according to ISO 11357-3:2011-05, or has a melt flow index (melt mass flow rate, melt flow rate (MFR)), which is greater than or equal to the melt flow index of the thermoplastic material of the retaining plate, the melt flow index being determined respectively according to ISO 1133-1:2011-12, at a nominal load of 2.16 kg and a temperature of 230° C.

10. The method according to claim 1, comprising welding or adhering:

a) the integral, frictional or form-fitting connection, at least in regions, of the wall of the vacuum cleaner filter bag to the textile material, b) the integral, frictional or form-fitting connection, at least in regions, of the retaining plate to the textile material, or c) the concluding production of the integral connection between the wall of the vacuum cleaner filter bag, the textile material and the retaining plate.

11. The method according to claim 1, wherein the wall of the vacuum cleaner filter bag, in the region of the application location, has a bag inlet opening, the textile material a through-opening, and the retaining plate and an inlet opening, the method comprising aligning the bag inlet opening, the through-opening and the inlet opening one above the other, or in the wall of the vacuum cleaner filter bag, in the region of the application location, there is introduced a bag inlet opening and in the textile material, a through-opening, the method comprising aligning the bag inlet opening, and the through-opening one above the other and with an inlet opening of the retaining plate.

12. The method according to claim 11, wherein the bag inlet opening or the through-opening are dimensioned smaller than or of equal size in diameter to the inlet opening.

13. The method according to claim 1, wherein at the application location of the retaining plate on the inside of the wall of the vacuum cleaner filter bag, at least one planar sealing element is introduced between the wall of the vacuum cleaner filter bag and the textile material or between the textile material and the retaining plate, the planar sealing element having a through-opening which is in alignment with the through-opening of the retaining plate, wherein the through opening of the planar sealing element has a smaller diameter than the diameter of the through-opening of the retaining plate.

14. The method according to claim 1, wherein an abutment side of the retaining plate is structured, at least in regions, or has energy directors for ultrasound, or when the wall of the vacuum cleaner filter bag, at least in the region of the application location of the retaining plate, is configured as a film or as a film laminate, the film or the film laminate is structured at least at the application location.

15. A method for integral connection of a retaining plate to a wall of a vacuum cleaner filter bag at an application location provided for this purpose, the method comprising:

a) in regions in the region of the application location of the retaining plate, at least in regions, producing an integral, frictional or form-fitting connection of the wall of the vacuum cleaner filter bag to at least one layer of a film made of a thermoplastic material, and pressing the retaining plate onto a side, provided with the film, of the wall of the vacuum cleaner filter bag, at the application location, or b) in regions on the retaining plate, at least in regions, producing an integral, frictional or form-fitting connection of the retaining plate to at least one layer of a film made of a thermoplastic material, and pressing the retaining plate with the side, provided with the film, onto the wall of the vacuum cleaner filter bag, at the application location, or c) between the wall of the vacuum cleaner filter bag and the retaining plate, in regions, in the region of the application location of the retaining plate, introducing at least one layer of a film made of a thermoplastic material, and pressing the retaining plate together with the film onto the wall of the vacuum cleaner filter bag, at the application location, and subsequently producing an integral connection between the wall of the vacuum cleaner filter bag, the film and the retaining plate.

16. A method for integral connection of a retaining plate to a wall of a vacuum cleaner filter bag at an application location, the method comprising: applying the retaining plate to at least a side of the wall of the vacuum cleaner filter bag, wherein the wall of the vacuum cleaner filter bag, at least in a region of the application location, consists of or is formed from, a film, a thermoplastic material or, a film laminate having a melting temperature which is less than or equal to, preferably less than the melting temperature of the thermoplastic material of the retaining plate, the melting temperature being determined respectively according to ISO 11357-3:2011-05, or having a melt flow index (melt mass flow rate, melt flow rate (MFR)), which is greater than or equal to the melt flow index of the thermoplastic material of the retaining plate, the melt flow index being determined respectively according to ISO 1133-1:2011-12, at a nominal load of 2.16 kg and a temperature of 230° C.

17. A vacuum cleaner filter bag comprising a wall with an application location for a retaining plate, and also the retaining plate which is connected integrally to the wall at the application location and is connected to the wall, at least in regions, via at least one layer of a textile material or layer of a film made of a thermoplastic material.

18. The vacuum cleaner filter bag according to claim 17, wherein the wall of the vacuum cleaner filter bag, at least at the application location of the retaining plate, is formed from a film made of a thermoplastic material, from a film laminate, in which at least the side on which the retaining plate is applied, made of a thermoplastic material or from a nonwoven made of a thermoplastic material.

19. The vacuum cleaner filter bag according to claim 17, wherein the wall of the vacuum cleaner filter bag, in the region of the application location, has a bag inlet opening, the textile material a through-opening and the retaining plate an inlet opening, the bag inlet opening, the through-opening and the inlet opening being brought into alignment one above the other, wherein the bag inlet opening or the through-opening is dimensioned smaller than or of equal size in diameter to the inlet opening.

20. The vacuum cleaner filter bag according to claim 17, wherein at the application location of the retaining plate on an inside of the wall of the vacuum cleaner filter bag, at least one planar sealing element is introduced between the wall of the vacuum cleaner filter bag and the textile material or between the textile material and the retaining plate, the planar sealing element has a through-opening which is in alignment with the through-opening of the retaining plate, wherein the through-opening of the planar sealing element has a smaller diameter than the diameter of the through-opening of the retaining plate.

21. The vacuum cleaner filter bag according to claim 17, wherein the wall of the vacuum cleaner filter bag, at least in the region of the application location, consisting of or being formed from, the film, the thermoplastic material, or a film laminate, in which at least the side on which the retaining plate is applied, the thermoplastic material, the thermoplastic material of the film or of the film laminate having a melting temperature which is less than or equal to the melting temperature of the thermoplastic material of the retaining plate, the melting temperature being determined respectively according to ISO 11357-3: 2011-05, or having a melt flow index (melt mass flow rate, melt flow rate (MFR)), which is greater than or equal to the melt flow index of the thermoplastic material of the retaining plate, the melt flow index being determined respectively according to ISO 1133-1:2011-12, at a nominal load of 2.16 kg and a temperature of 230° C.

* * * * *